US010278554B2

(12) United States Patent
Bey

(10) Patent No.: US 10,278,554 B2
(45) Date of Patent: May 7, 2019

(54) AUTOMATIC SQUEEGEE ASSEMBLY

(71) Applicant: M Solomon Bey, Minneapolis, MN (US)

(72) Inventor: M Solomon Bey, Minneapolis, MN (US)

( * ) Notice: Subject to any disclaimer, the term of this patent is extended or adjusted under 35 U.S.C. 154(b) by 19 days.

(21) Appl. No.: 15/600,623

(22) Filed: May 19, 2017

(65) Prior Publication Data

US 2018/0014704 A1 Jan. 18, 2018

Related U.S. Application Data

(60) Provisional application No. 62/362,057, filed on Jul. 14, 2016.

(51) Int. Cl.
*A47L 1/05* (2006.01)
*A47L 1/08* (2006.01)

(52) U.S. Cl.
CPC ..... *A47L 1/08* (2013.01); *A47L 1/05* (2013.01); *A47L 2201/04* (2013.01); *A47L 2201/06* (2013.01)

(58) Field of Classification Search
CPC ..... A47L 1/02; A47L 1/08; A47L 1/05; A47L 2201/04; A47L 2201/06
USPC ..... 15/97.1, 103, 98, 102, 245
See application file for complete search history.

(56) References Cited

U.S. PATENT DOCUMENTS 1,783,506 A 12/1930 Homiller
2,517,474 A * 8/1950 Fouse ..... A47L 1/02 15/103
3,218,663 A * 11/1965 Battista ..... A47L 1/02 15/250.11
3,292,196 A * 12/1966 Windorf ..... A47L 1/02 15/103
3,293,678 A 12/1966 South
3,461,476 A * 8/1969 North ..... A47L 1/02 15/103
3,584,330 A 6/1971 Wallin
4,198,724 A * 4/1980 Fisher ..... A47L 1/02 15/103
6,010,267 A 1/2000 Vito
7,523,517 B2 * 4/2009 Yu ..... E04G 23/002 15/103
7,530,136 B1 5/2009 Ball

FOREIGN PATENT DOCUMENTS

DE 2555648 * 6/1977

* cited by examiner

*Primary Examiner* — Gary K. Graham
(74) *Attorney, Agent, or Firm* — Integrity Patent Group, PLC; Charles E. Runyan

(57) ABSTRACT

The automatic squeegee assembly includes an energy storage charger, a main body configured as a housing, and a squeegee arm assembly coupled to the main body. The main body includes a base configured to rest upon a substantially horizontal surface, an energy storage, an energy storage charger port electrically coupled to the energy storage, and configured to electrically couple to the energy storage charger, a fluid container removably coupled to the main body, the fluid container configured for refillably containing a cleaning fluid, a cleaning fluid pump fluidly coupled to the fluid container and configured to dispense the cleaning fluid, a handle including a user interface configured to operate the cleaning fluid pump, and an access port configured secure and to allow removal of the fluid container.

17 Claims, 5 Drawing Sheets

AUTOMATIC SQUEEGEE ASSEMBLY

CROSS-REFERENCE TO RELATED APPLICATION

The present application is related to and claims priority to U.S. Provisional Patent Application No. 62/362,057 filed Jul. 14, 2016, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of The Invention

The present invention relates generally to the field of window cleaning, and more specifically relates to window squeegees.

2. Description of Related Art

Cleaning windows can be a laborious and tedious task. Individuals often need to use one hand to spray cleaning solution, while their other hand is occupied with paper towels or cloths to wipe down the window. More often than not, users end up with streaked windows because they are not able to get all of the cleaning solution wiped off in time. In addition, it can be extremely difficult for individuals with limited mobility or pain conditions to thoroughly clean windows. Window heights often require the user to stand on a step stool or ladder.

U.S. Pat. No. 3,584,330 to Wallin and Hahn relates to a Portable Power Operated Window Washer. The described Portable Power Operated Window Washer includes a portable self-contained power operated window washer characterized by the absence of auxiliary containers for clean or used cleaning fluid and hose connections therefor.

Although prior window cleaning solutions exist a more efficient method is needed.

BRIEF SUMMARY OF THE INVENTION

In view of the foregoing disadvantages inherent in the known window cleaning art, the present disclosure provides a novel automatic squeegee assembly. The general purpose of the present disclosure, which will be described subsequently in greater detail, is to provide an automatic squeegee assembly.

An automatic squeegee assembly is disclosed herein. The automatic squeegee assembly includes an energy storage charger, a main body configured as a housing, and a squeegee arm assembly coupled to the main body. The main body includes a base configured to rest upon a substantially horizontal surface, an energy storage, an energy storage charger port electrically coupled to the energy storage, and configured to electrically couple to the energy storage charger, a fluid container removably coupled to the main body, the fluid container configured for refillably containing a cleaning fluid, a cleaning fluid pump fluidly coupled to the fluid container and configured to dispense the cleaning fluid, a handle including a user interface configured to operate the cleaning fluid pump, and an access port configured secure and to allow removal of the fluid container. The squeegee arm assembly includes a plurality of dispensers plumbed and configured to dispense the cleaning liquid from the fluid container, a squeegee blade, an axial extender electrically coupled to the energy storage, the axial extender configured to extend the squeegee head horizontally from the main body, and a longitudinal extender electrically coupled to the energy storage, the longitudinal extender configured to swipe the squeegee blade across a flat surface.

According to another embodiment, a method for cleaning windows is also disclosed herein. The method for cleaning windows includes the steps of charging the energy storage, loading the removable container, latching the base, positioning the squeegee head against a window, activating the plurality of dispensers, and squeegeeing the window clean.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an automatic squeegee assembly, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a window cleaning and more particularly to an automatic squeegee assembly as used to improve the cleaning windows.

Generally speaking, the disclosure provides users with an easy and convenient method for cleaning windows. The disclosure offers a window cleaning solution for homeowners, landlords, janitorial services and more. The disclosure enables users to hold the device during operation, or in alternate embodiments it can be used as a standalone unit as it operates automatically. The present disclosure promotes easy window cleaning by offering an automated cleaning fluid spray and squeegee arm. As such it eliminates the need to use one hand for spraying cleaning solution and one hand for wiping down the window.

Figure 1:
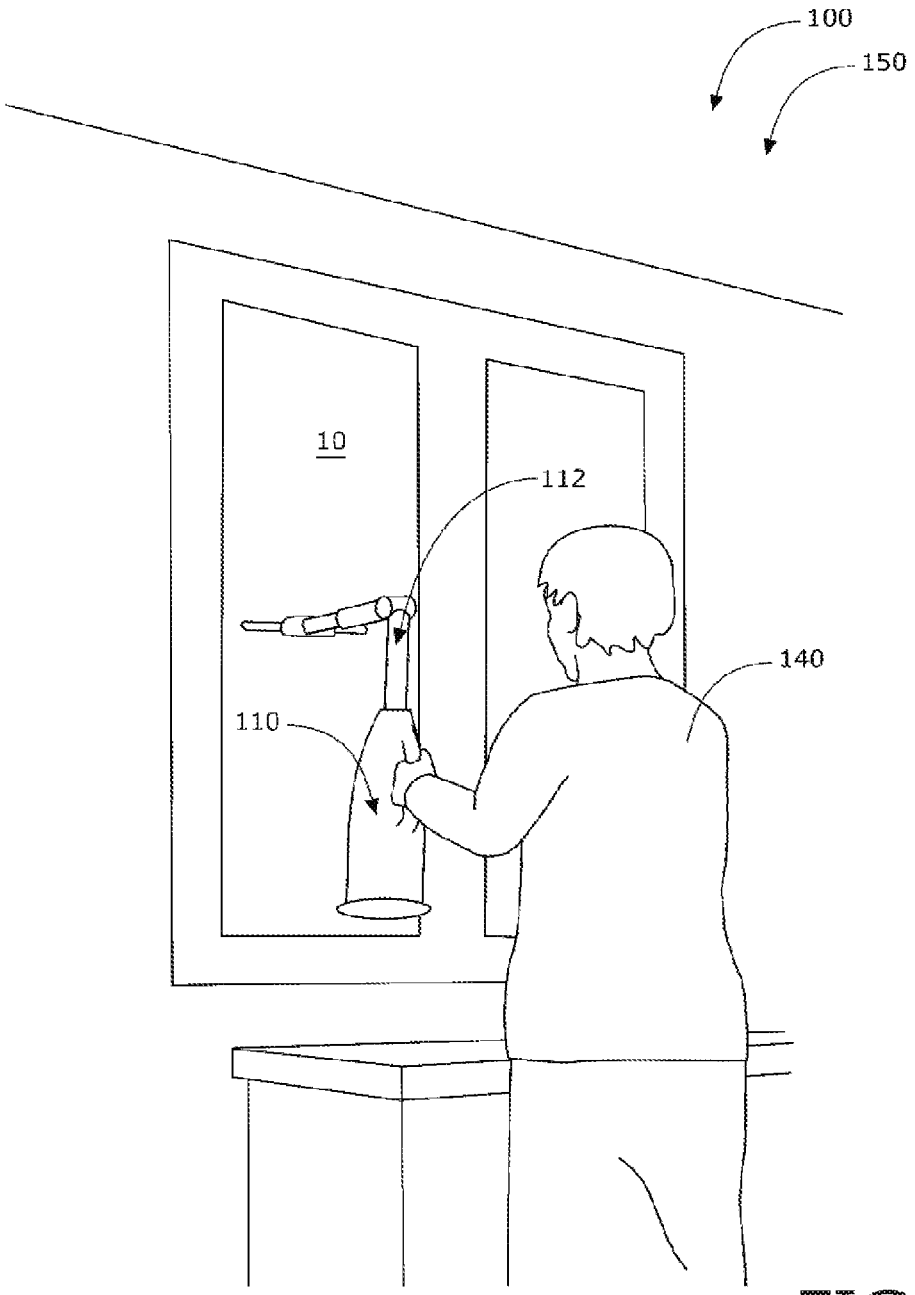
FIG. 1 is a view of the automatic squeegee assembly during an 'in-use' condition, according to an embodiment of the disclosure.

Referring now more specifically to the drawings by numerals of reference, there is shown in FIGS. 1-4, various views of an automatic squeegee assembly 100. FIG. 1 shows an automatic squeegee assembly during an 'in-use' condition 150, according to an embodiment of the present disclosure. Here, the automatic squeegee assembly 100 may be beneficial for use by a user 140 to clean a window 10. Broadly, the automatic squeegee assembly 100 may include a squeegee arm assembly 112 coupled to a main body 110.

Figure 2:
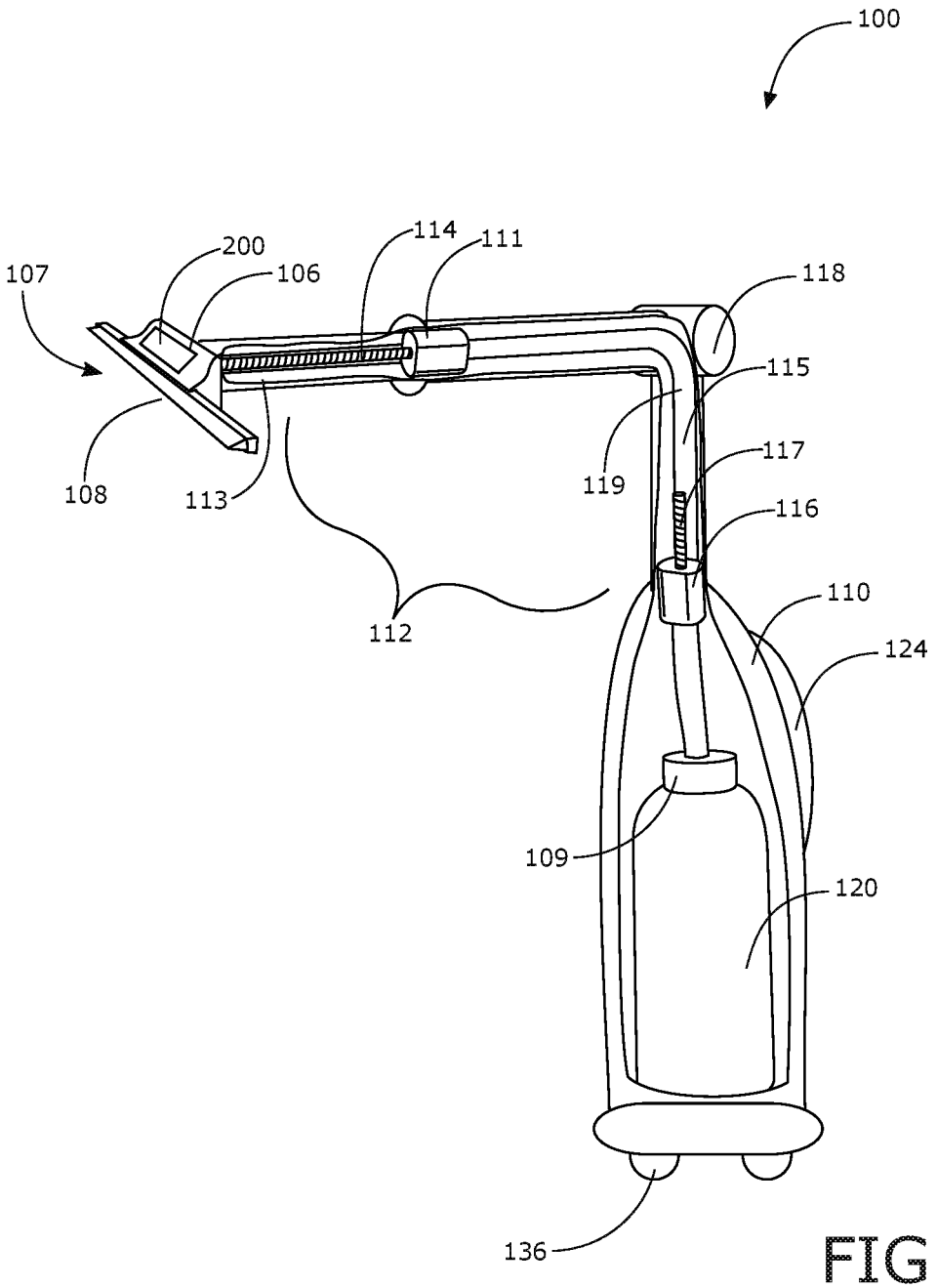
FIG. 2 is a cutaway view of the automatic squeegee assembly of FIG. 1, showing internal components of the automatic squeegee assembly, according to an embodiment of the present disclosure.

FIG. 2 shows the automatic squeegee assembly 100 of FIG. 1, according to an embodiment of the present disclosure. The automatic squeegee assembly 100 may include a main body 110 that is connected to the squeegee arm assembly 112. The squeegee arm assembly 112 may include a flexible elbow 118, a extender arm 113 including a extender arm motor 111 and a extender arm screw gear assembly 114, a vertical extender arm 115 including a vertical extender arm motor 116 and a vertical extender arm screw gear assembly 117. The squeegee arm assembly 112 may be configured for use as an extension means or mechanism for cleaning the window 10 (FIG. 1). The squeegee arm assembly 112 may include a flexible tube 119, and squeegee head 106 having a squeegee blade 107 and a plurality of dispensers 108 configured to dispense a cleaning liquid.

The main body 110 may include an energy storage 134 (FIG. 3), a cleaning fluid pump 109, a fluid container 120, and a handle 124. The handle 124 may include a user interface 126 (FIG. 3) that is configured to activate the extender arm motor 111, the vertical extender arm motor 116, and the cleaning fluid pump 109. The user interface 126 may be embodied as a multi-function control switch.

The user interface 126 and the cleaning fluid pump 109 may be configured to work together in functional combination for supplying cleaning fluid to the plurality of dispensers 108. The energy storage 134, user interface 126, cleaning fluid pump 109, extender arm motor 111 and vertical extender arm motor 116 may be electrically coupled.

The flexible tube 119, plurality of dispensers 108, cleaning fluid pump 109, and fluid container 120 may be configured to work together in functional combination for dispensing cleaning liquid by pumping fluid from the fluid container 120 through the flexible tube 119 to the dispensing head 106. The flexible tube 119 may run through hollow shafts in the extender arm screw gear assembly 114 and the vertical extender arm screw gear assembly 117.

The extender arm motor 111 and the extender arm screw gear assembly 114 may be configured to work together in functional combination to extend the extender arm 113 in a direction perpendicular to the main body for extending the user's reach when washing a window 10. Similarly, the vertical extender arm motor 116 and the vertical extender arm screw gear assembly 117 may be configured to work together in functional combination to extend the vertical extender arm 115 in an axial direction with respect to the main body 110 for elevating the squeegee head 106 height to clean higher areas of a window 10. The flexible elbow 118 may be configured to allow multiple position adjustments between the extender arm 113 and the vertical extender arm 115 as a means or mechanism for maintaining constant contact with the window 10 during a cleaning motion.

It should be understood that various embodiment are contemplated. For example, according to one embodiment, the squeegee head 106 may be removable and replaceable. According to another embodiment, the automatic squeegee assembly 100 may be configured to operate in an autonomous mode, and the user interface 126 may be configured to engage the autonomous operating mode. According to another embodiment, a second flexible elbow 118 may be implemented between the main body 110 and the vertical extender arm 115. According to yet another embodiment, the squeegee head 106 may contain a motorized pivoting assembly 200 with respect to the extender arm 113. In yet another embodiment, intelligent circuitry is employed for controlling the squeegee arm assembly 112. In alternate embodiments, the disclosure may include a second flexible elbow, motorized pivoting assembly, and position sensors to keep the squeegee head properly positioned with respect to the window 10 as a means for proper cleaning. In this embodiment, the second flexible elbow may be located between the main body 110 and squeegee arm assembly 112. The automatic squeegee assembly may have wheels 136.

Figure 3:
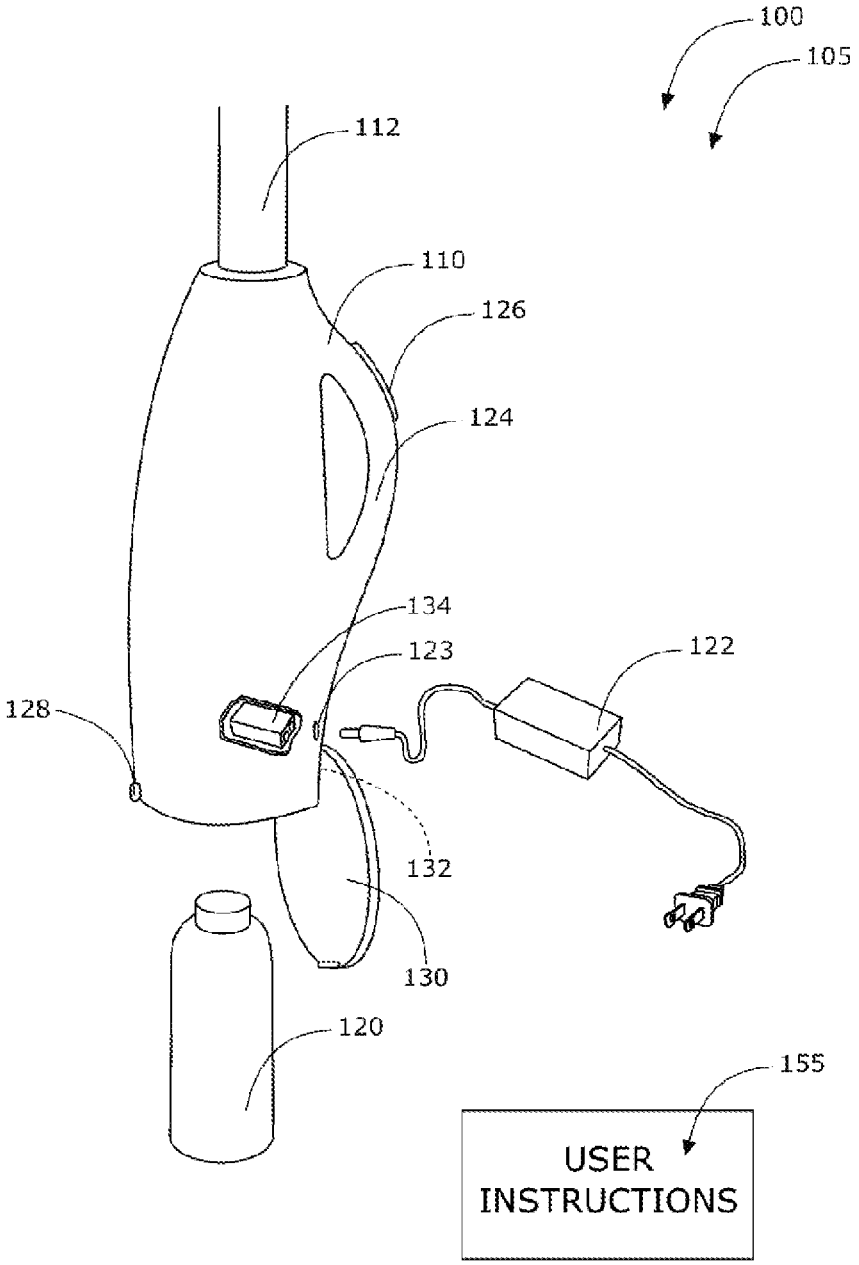
FIG. 3 is a partial exploded view of the automatic squeegee assembly of FIG. 1, according to an embodiment of the present disclosure.

FIG. 3 is a partial exploded view of the automatic squeegee assembly 100 of FIG. 1, according to an embodiment of the present disclosure. According to this embodiment, the automatic squeegee assembly 100 may be arranged as a kit 105. In particular, the automatic squeegee assembly 100 may further include a set of instructions 155 and an energy storage charger 122. The instructions 155 may detail functional relationships in relation to the structure of the automatic squeegee assembly 100 (such that the automatic squeegee assembly 100 can be used, maintained, or the like, in a preferred manner).

The automatic squeegee assembly 100 may include a main body 110 including the energy storage 134, an energy storage charger port 123 electrically coupled to the energy storage 134, the handle 124 having a multi-function control switch, a fluid container 120, a base 130, one or more hinges 132, and a latch 128. The energy storage 134 powers the automatic squeegee assembly 100.

In the preferred embodiment, main body 110 is rigidly attached to squeegee arm assembly 112. According to another embodiment, the fluid container 120 is a prefilled cartridge. According to another embodiment, the fluid container 120 has a snap-fit, sealed connection. According to another embodiment, the fluid container 120 has a screw cap connection. According to another embodiment, the device can operate in an autonomous mode as a means for washing a window 10 while placed on a surface. According to another embodiment, the base 130 acts as a mobile platform with wheels 136 for supporting the automatic squeegee assembly 100 during autonomous operation.

Figure 4:
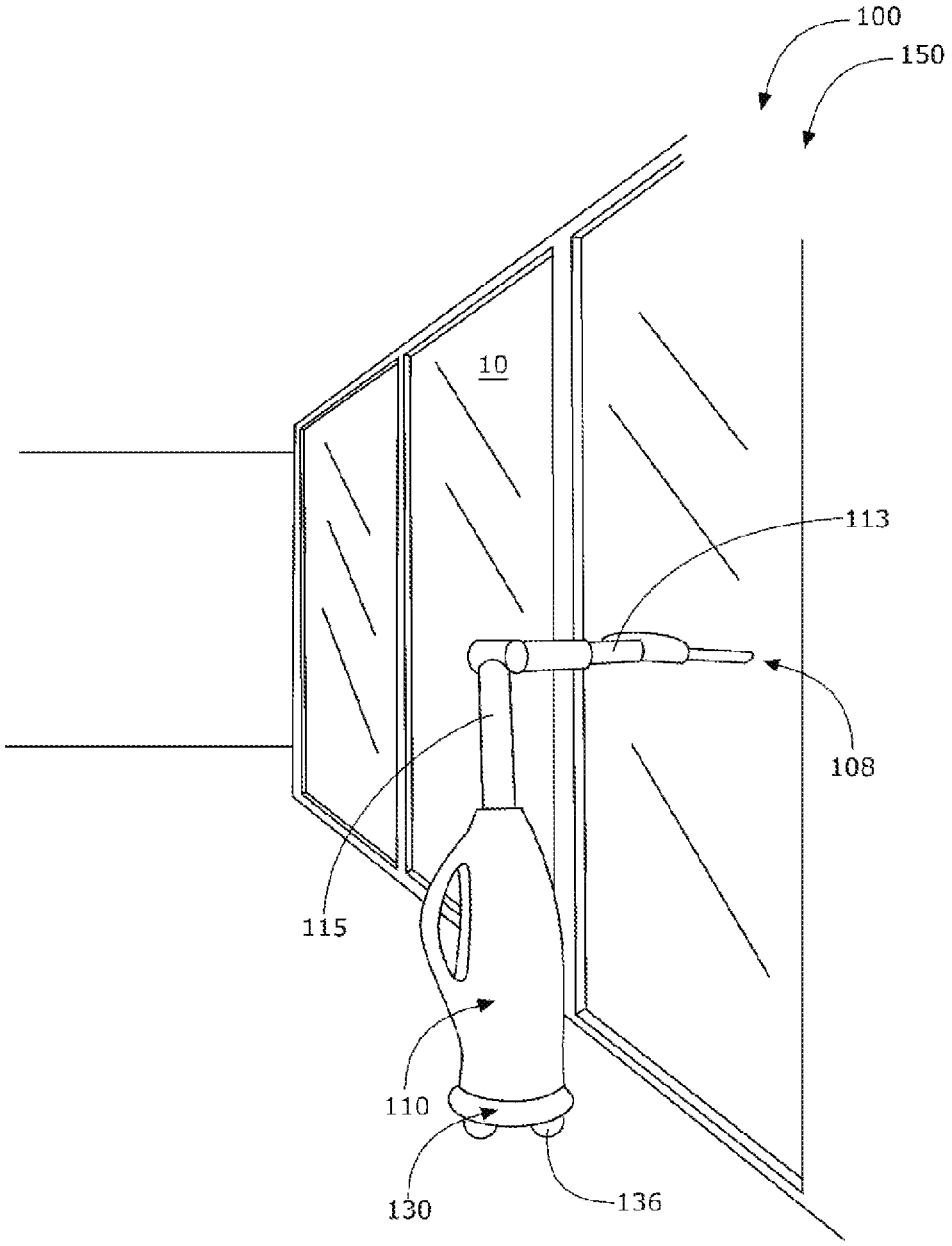
FIG. 4 is a side view of the automatic squeegee assembly of FIG. 1, during an autonomous operation in 'in-use' condition, according to an embodiment of the disclosure.

FIG. 4 is a view of the automatic squeegee assembly 100 of FIG. 1, according to an alternate embodiment of the present disclosure during an 'in-use' 150 condition. Automatic squeegee assembly 100 is shown operating in autonomous mode while cleaning window 10 and supported by base 130. In this embodiment, base 130 is motorized for moving in directions along the horizontal plane (e.g., the floor).

According to another embodiment, flexible elbow 108 is rigidly fixed in a manner that forms a ninety degree angle between extender arm 113 and vertical extender arm 115. According to another embodiment, extender arm 113 is rigidly fixed to flexible elbow 118. According to another embodiment, the vertical extender arm 115 is rigidly fixed to flexible elbow 118.

Figure 5:
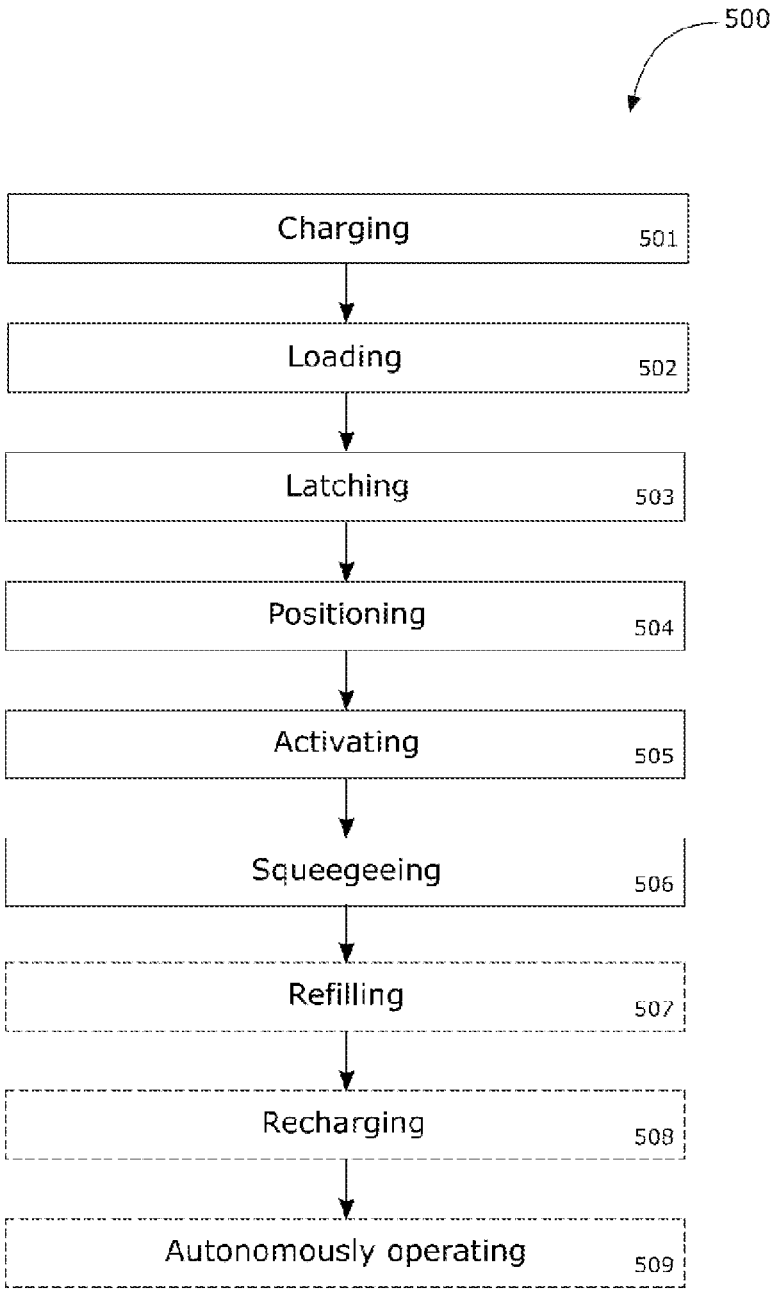
FIG. 5 is a flow diagram illustrating a method of use/for cleaning windows, according to an embodiment of the present disclosure.

FIG. 5 is a flow diagram illustrating a method for cleaning a window 500, according to an embodiment of the present disclosure. In particular, the method for cleaning a window 500 may include one or more components or features of automatic squeegee assembly 100 as described above. As illustrated, the method for cleaning a window 500 may include the steps of: step one 501, charging the energy storage 134; step two 502, loading the fluid container 120 with cleaning fluid; step three 503, latching the base 130; step four 504, positioning the squeegee head 106 against a window 10; step five 505, activating the plurality of dispensers 108; and step six 506, squeegeeing window 10 clean. The method of use for cleaning a window 500 may also include step seven 507, refilling removable container 120; step eight 508, recharging energy storage 134; and step nine 509, autonomous operation.

It should be noted that steps 507, 508, and 509 are an optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for cleaning a window 10 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An automatic squeegee assembly comprising:
an energy storage charger;
a main body configured as a housing, and including
a base configured to rest upon a substantially horizontal surface,
an energy storage,
an energy storage charger port electrically coupled to the energy storage, and configured to electrically couple to the energy storage charger,
a fluid container removably coupled to the main body, the fluid container configured for refillably containing a cleaning fluid,
a cleaning fluid pump fluidly coupled to the fluid container and configured to dispense the cleaning fluid,
a handle including a user interface configured to operate the cleaning fluid pump,
an access port configured to secure and to allow removal of the fluid container;
and
a squeegee arm assembly coupled to the main body, the squeegee arm assembly including
a plurality of dispensers plumbed and configured to dispense the cleaning liquid from the fluid container,
a squeegee blade,
an axial extender electrically coupled to the energy storage, the axial extender configured to extend the squeegee head horizontally from the main body, and
a longitudinal extender electrically coupled to the energy storage, the longitudinal extender configured to swipe the squeegee blade across a flat surface.

2. The automatic squeegee assembly of claim 1, wherein the squeegee blade is removable and replaceable.

3. The automatic squeegee assembly of claim 1, wherein the fluid container is a prefilled cartridge.

4. The automatic squeegee assembly of claim 1, wherein the fluid container includes a snap-fit, sealed connection.

5. The automatic squeegee assembly of claim 1, wherein the fluid container includes a screw cap connection.

6. The automatic squeegee assembly of claim 1, wherein the automatic squeegee assembly is configured to operate in an autonomous mode as a means for washing windows while placed on a horizontal surface.

7. The automatic squeegee assembly of claim 6, wherein the base acts as a mobile platform for supporting the automatic squeegee assembly with wheels for enabling lateral movement along the horizontal surface during autonomous operation.

8. The automatic squeegee assembly of claim 6, wherein the user interface is operable to engage the autonomous mode of operation.

9. The automatic squeegee assembly of claim 1, wherein the squeegee arm assembly further includes an elbow operably integrated between the axial extender and the longitudinal extender and forming a ninety-degree angle in a vertical plane therebetween.

10. The automatic squeegee assembly of claim 9, wherein the axial extender includes a squeegee head including a motorized pivoting assembly configured to pivot in a vertical plane with respect to the axial extender.

11. The automatic squeegee assembly of claim 10, wherein intelligent circuitry is employed for controlling the squeegee arm assembly and motorized pivoting assembly.

12. The automatic squeegee assembly of claim 9, wherein the elbow is rigid.

13. The automatic squeegee assembly of claim 1, wherein the axial extender includes an extender arm, an extender arm motor, and an extender arm screw gear assembly.

14. The automatic squeegee assembly of claim 1, wherein the longitudinal extender includes a vertical extender arm, a vertical extender arm motor, and a vertical extender arm screw gear assembly.

15. The automatic squeegee assembly of claim 1, wherein the axial extender is a rigid assembly.

16. An automatic squeegee assembly comprising:
an energy storage charger;
a main body configured as a housing, and including
a base configured to rest upon a substantially horizontal surface,
an energy storage,
an energy storage charger port electrically coupled to the energy storage, and configured to electrically couple to the energy storage charger,
a fluid container removably coupled to the main body, the fluid container configured for refillably containing a cleaning fluid,
a cleaning fluid pump fluidly coupled to the fluid container and configured to dispense the cleaning fluid, a handle including a user interface configured to operate the cleaning fluid pump, an access port configured to secure and to allow removal of the fluid container;

and a squeegee arm assembly coupled to the main body, the squeegee arm assembly including a plurality of dispensers plumbed and configured to dispense the cleaning liquid from the fluid container, a squeegee blade, an axial extender electrically coupled to the energy storage, the axial extender configured to extend the squeegee head horizontally from the main body, and a longitudinal extender electrically coupled to the energy storage, the longitudinal extender configured to swipe the squeegee blade across a flat surface;

wherein the squeegee blade is removable and replaceable;

wherein the fluid container is a prefilled cartridge;

wherein the fluid container includes a screw cap connection;

wherein the automatic squeegee assembly is configured to operate in an autonomous mode as a means for washing windows while placed on a horizontal surface;

wherein the base acts as a mobile platform for supporting the automatic squeegee assembly and enabling lateral movement along the horizontal surface during autonomous operation;

wherein the user interface enables is operable to engage the autonomous mode of operation;

wherein the squeegee arm assembly further includes an elbow operably integrated between the axial extender and the longitudinal extender, and forming a ninety-degree angle in a vertical plane therebetween;

wherein the axial extender includes a squeegee head including a motorized pivoting assembly configured to pivot in a vertical plane with respect to the axial extender;

wherein intelligent circuitry is employed for controlling the squeegee arm assembly and motorized pivoting assembly;

and wherein the longitudinal extender includes a vertical extender arm, a vertical extender arm motor, and a vertical extender arm screw gear assembly.

17. The automatic squeegee assembly of claim 16, further comprising set of instructions wherein the automatic squeegee assembly system is arranged with the instructions as a kit including an energy storage charger.

* * * * *